US008771025B2

(12) United States Patent
Lee

(10) Patent No.: US 8,771,025 B2
(45) Date of Patent: Jul. 8, 2014

(54) ELECTRICAL POWER CONNECTOR

(71) Applicant: RIIDEA International Corp., Apia (WS)

(72) Inventor: Lung-Hsi Lee, New Taipei (TW)

(73) Assignee: RIIDEA International Corp., Apia (WS)

( * ) Notice: Subject to any disclaimer, the term of this patent is extended or adjusted under 35 U.S.C. 154(b) by 0 days.

(21) Appl. No.: 13/921,770

(22) Filed: Jun. 19, 2013

(65) Prior Publication Data

US 2014/0030932 A1 Jan. 30, 2014

(30) Foreign Application Priority Data

Jul. 27, 2012 (TW) ..... 101214650 A

(51) Int. Cl.
*H01R 13/405* (2006.01)
*H01R 43/24* (2006.01)
*H01R 24/66* (2011.01)

(52) U.S. Cl.
CPC ..... *H01R 43/24* (2013.01); *H01R 24/66* (2013.01)
USPC ..... 439/736; 439/693; 439/722

(58) Field of Classification Search
CPC ..... H01R 43/24; H01R 24/66
USPC ..... 439/693, 722, 736
See application file for complete search history.

(56) References Cited

U.S. PATENT DOCUMENTS

| | | | | |
|---|---|---|---|---|
| 3,708,612 | A * | 1/1973 | Saxon et al. | 174/142 |
| 3,820,060 | A * | 6/1974 | Smith | 439/671 |
| 4,664,466 | A * | 5/1987 | Bleger et al. | 439/544 |
| 5,827,094 | A * | 10/1998 | Aizawa et al. | 439/857 |
| 6,206,735 | B1 * | 3/2001 | Zanolli | 439/736 |
| 7,000,317 | B1 * | 2/2006 | Spykerman | 29/883 |
| 7,121,899 | B2 * | 10/2006 | Homann et al. | 439/680 |
| 7,578,700 | B2 * | 8/2009 | Xiong et al. | 439/607.01 |
| 7,645,171 | B2 * | 1/2010 | Mott et al. | 439/722 |
| 8,491,332 | B1 * | 7/2013 | Mo et al. | 439/568 |
| 2005/0195547 | A1 * | 9/2005 | Huang | 361/103 |
| 2008/0124987 | A1 * | 5/2008 | Chow et al. | 439/736 |
| 2013/0017724 | A1 * | 1/2013 | Liu | 439/607.34 |
| 2013/0227839 | A1 * | 9/2013 | Lee | 29/858 |
| 2014/0030932 | A1 * | 1/2014 | Lee | 439/693 |

* cited by examiner

*Primary Examiner* — James Harvey
(74) *Attorney, Agent, or Firm* — Muncy, Geissler, Olds & Lowe, P.C.

(57) ABSTRACT

An electrical power connector includes a plurality of conducting terminals and an electrically insulative terminal block directly molded on the conducting terminals by insert molding. Each conducting terminal has a mating contact portion suspending in a front mating receiving hole of the electrically insulative terminal block, a plate-like mounting portion bent into shape and partially embedded in the electrically insulative terminal block and partially extending out of the bottom side of the electrically insulative terminal block, one or multiple through holes cut through the plate-like mounting portion and embedded in the electrically insulative terminal block, and a bent portion located at the plate-like mounting portion and transversely extending across each through hole and embedded in the electrically insulative terminal block.

8 Claims, 10 Drawing Sheets

ELECTRICAL POWER CONNECTOR

This application claims the priority benefit of Taiwan patent application number 101214650, filed on Jul. 27, 2012.

BACKGROUND OF THE INVENTION

1. Field of the Invention

The present invention relates to electrical connector technology and more particularly, to an electrical power connector in which each conducting terminal has at least one through hole in a plate-like mounting portion thereof so that the plate-like mounting portion can be bent into the desired shape without causing much stress to the plate-like mounting portion, avoiding conducting terminal damage.

2. Description of the Related Art

Power sockets are widely used in electric and electronic devices, such as portable audio, audio and video players (such as VCD and DVD players), computer, notebook computer, mobile phone and other information products for connection to a city power outlet for power input so that the electric and electronic devices can obtain the necessary working power supply and can be operated by a user.

A power socket has at least one metal contact (conducting terminal) that can be made in a one-piece form, or by means of riveting. A riveted type metal contact (conducting terminal), as shown in FIG. 9, is made by: using a press or lathe to process a metal wire rod into a mating contact member A, and then employing a stamping technique to stamp a metal sheet material into a flat mounting member B, and then employing a riveting technique to connect a rear end A1 of the mating contact member A to the flat mounting member B, and then bending the flat mounting member B to form an oblique tailpiece B1. After preparation of multiple riveted type metal contacts (conducting terminals), employ an insert molding technique to mold an electrically insulative terminal block C on the riveted type metal contacts (conducting terminals). The fabrication of these riveted type metal contacts (conducting terminals) is complicated, increasing the manufacturing cost and lowering the product yield rate.

A one-piece metal contact (conducting terminal), as shown in FIG. 10, is made by: employing a stamping technique to process a metal wire rod into a mating contact portion D at one end, a bonding portion D2 at an opposite end, a connection portion D1 on the middle between the mating contact portion D and the bonding portion D2, and a bent portion D3 at the connection area between the connection portion D1 and the mating contact portion D. After formation of a large amount of one-piece metal contacts (conducting terminals), an electrically insulative terminal block is molded on a predetermined number of one-piece metal contacts (conducting terminals) by insert molding. According to this fabrication method, each metal wire rod is stamped several times to form the desired mating contact portion D, connection portion D1, bonding portion D2 and bent portions D3. Repeatedly stamping may harden the metal material, like cold forging, and the one-piece metal contact (conducting terminal) may break at each bent portion D3 easily during shape forming.

Therefore, it is desirable to provide an electrical power connector, which eliminates the aforesaid problems during fabrication of the metal contacts (conducting terminals).

SUMMARY OF THE INVENTION

The present invention has been accomplished under the circumstances in view. It is therefore the main object of the present invention to provide an electrical power connector, which prevents breaking of the conducting terminals during fabrication, improving the product yield rate. It is another object of the present invention to provide an electrical power connector, which enables the conducting terminals and the electrically insulative terminal block to be fixedly secured together, avoiding conducting terminal displacement and prolonging the product lifespan.

To achieve these and other objects of the present invention, an electrical power connector of the present invention comprises a plurality of conducting terminals, and an electrically insulative terminal block directly molded on the conducting terminals by insert molding. Each conducting terminal comprises a mating contact portion disposed at one end thereof and suspending in a front mating receiving hole of the electrically insulative terminal block, a plate-like mounting portion disposed at an opposite end thereof and partially embedded in the electrically insulative terminal block and partially extended out of the bottom side of the electrically insulative terminal block, at least one through hole located at the plate-like mounting portion and embedded in the electrically insulative terminal block, and a bent portion transversely extending across each through hole at the plate-like mounting portion and embedded in the electrically insulative terminal block. The design of the at least one through hole at the plate-like mounting portion of each conducting terminal enables the plate-like mounting portion to be bent into the desired shape without causing much stress to the plate-like mounting portion, avoiding conducting terminal damage.

Further, when molding the electrically insulative terminal block on the conducting terminals, the applied molten plastic material can fill up the through holes at the plate-like mounting portions of the conducting terminals, and therefore the conducting terminals can be firmly secured to the electrically insulative terminal block against displacement after the electrically insulative terminal block is made, thereby prolonging the product lifespan.

Further, each conducting terminal comprises a shoulder connected between the associating mating contact portion and plate-like mounting portion and embedded in the electrically insulative terminal block. The shoulder has two opposite lateral sides thereof respectively transversely protrude over the outer diameter of the mating contact portion and the outer diameter of the plate-like mounting portion. Because the shoulders of the conducting terminals are embedded in the electrically insulative terminal block, they can positively stop the respective conducting terminals against axial displacement relative to the electrically insulative terminal block during application of the electrical power connector, thereby prolonging the product lifespan.

DETAILED DESCRIPTION OF THE PREFERRED EMBODIMENT

Figure 1:
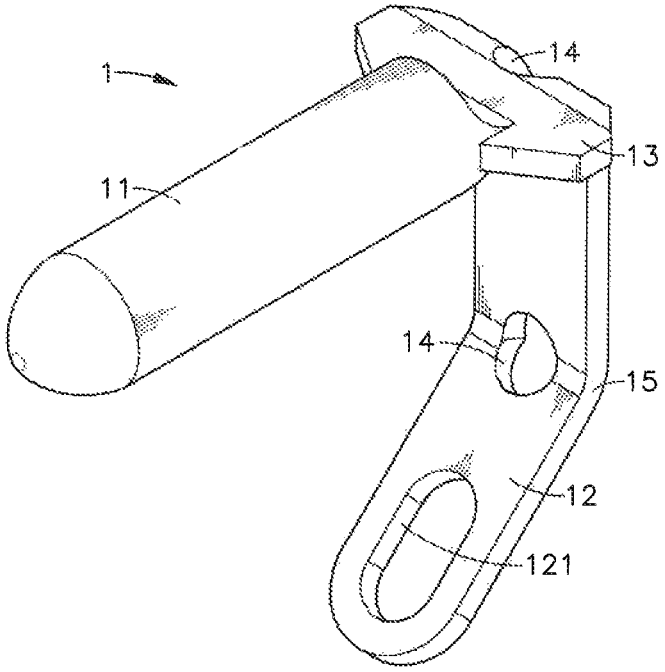
FIG. 1 is an oblique top elevational view of a conducting terminal for electrical power connector in accordance with the present invention.
Figure 2:
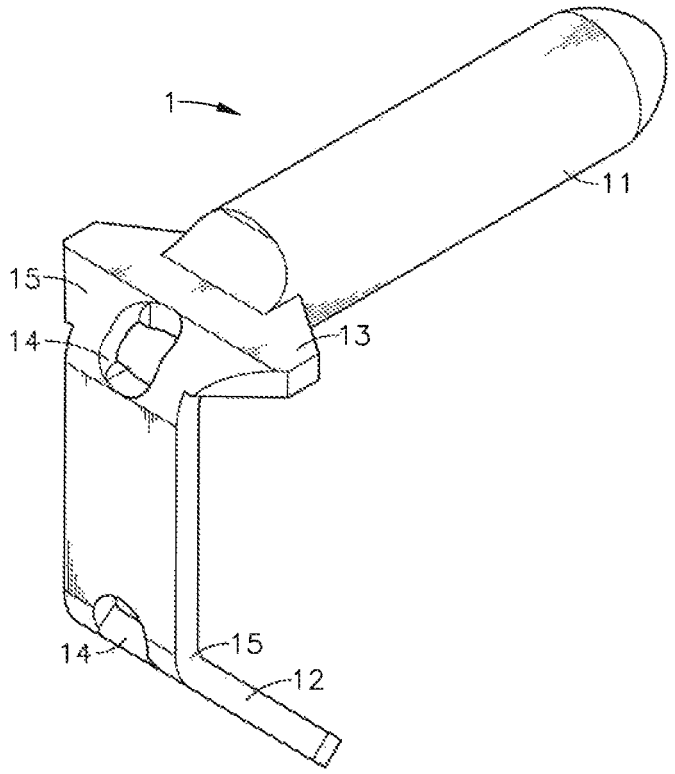
FIG. 2 corresponds to FIG. 1 when viewed from another angle.
Figure 3:
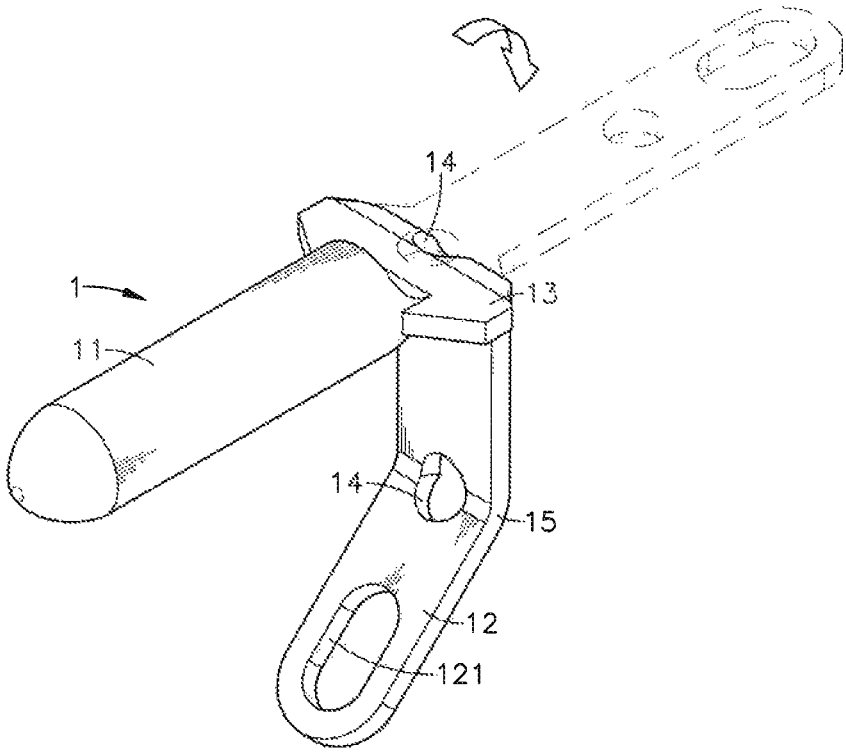
FIG. 3 is a schematic drawing illustrating a conducting terminal bending operation during the fabrication of a conducting terminal in accordance with the present invention.
Figure 4:
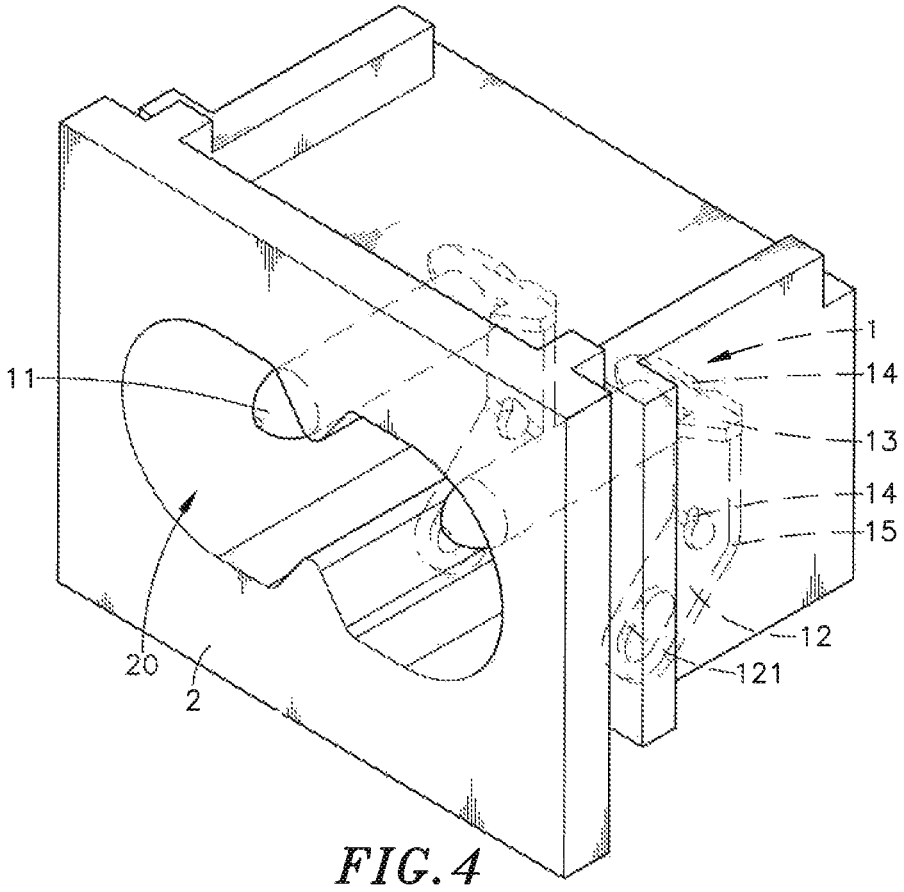
FIG. 4 is a perspective view of an electrical power connector in accordance with the present invention.
Figure 5:
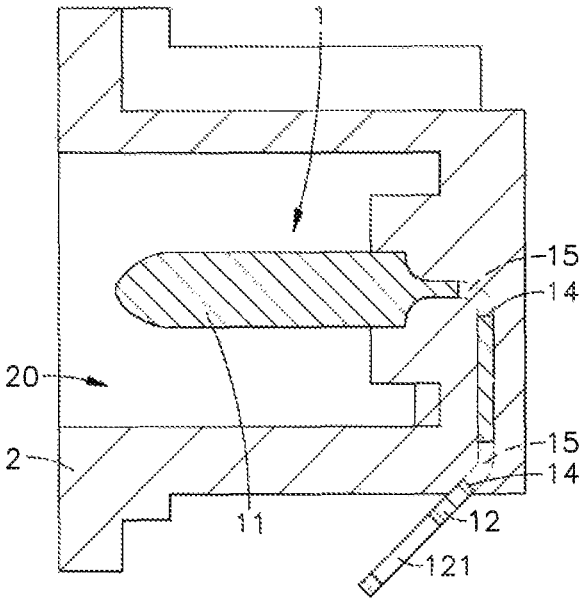
FIG. 5 is a sectional side view of the electrical power connector shown in FIG. 4.
Figure 6:
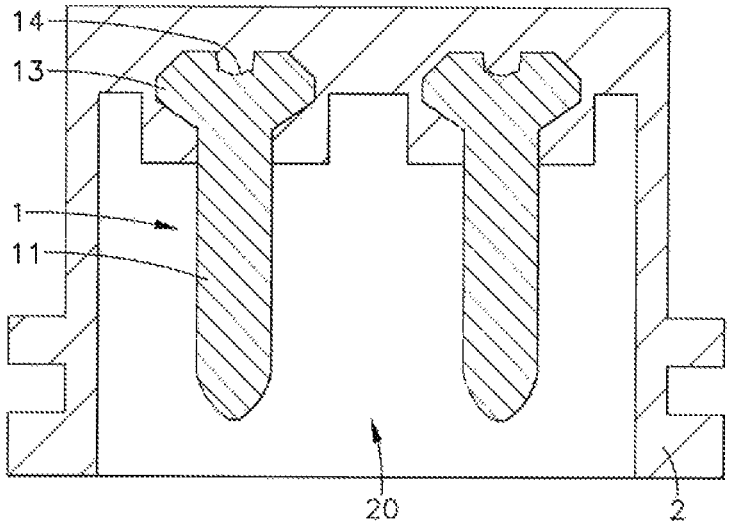
FIG. 6 is a sectional top view of the electrical power connector shown in FIG. 4.

Referring to FIGS. 1-6, an electrical power connector in accordance with the present invention is shown. The electrical power connector comprises an electrically insulative terminal block 2, and a plurality of conducting terminals 1 mounted in the electrically insulative terminal block 2.

The conducting terminals 1 are made out of metal, each comprising a mating contact portion 11 disposed at one end, a plate-like mounting portion 12 disposed at an opposite end, a shoulder 13 connected between the mating contact portion 11 and the plate-like mounting portion 12 and bilaterally protruding over the outer diameter of the mating contact portion 11 and the outer diameter of the plate-like mounting portion 12, and at least one, for example, two through holes 14 cut through the plate-like mounting portion 12. Further, the conducting terminals 1 can be configured each having at least one bent portion 15 located at the plate-like mounting portion 12 and respectively transversely extending across each through hole 14.

The electrically insulative terminal block 2 is formed of a plastic material on the conducting terminals 1 by insert molding, defining a front mating receiving hole 20 for receiving an external mating electrical power connector. After formation of the electrically insulative terminal block 2 on the conducting terminals 1, the mating contact portions 11 of the conducting terminals 1 suspend in the front mating receiving hole 20 of the electrically insulative terminal block 2, the shoulders 13 of the conducting terminals 1 are embedded in the electrically insulative terminal block 2, and the plate-like mounting portions 12 of the conducting terminals 1 extend out of the electrically insulative terminal block 2.

The conducting terminals 1 are made of metal wire rods using a stamping technique. The mating contact portions 11 of the conducting terminals 1 can be rod-shaped, having a circular, rectangular or any other geometrical cross section. Further, the through holes 14 can have a circular, oval, rectangular or any other geometrical shape. Further, the plate-like mounting portion 12 can be processed to provide a bonding hole 121 for the connection of a lead wire or board end by welding.

Figure 7:
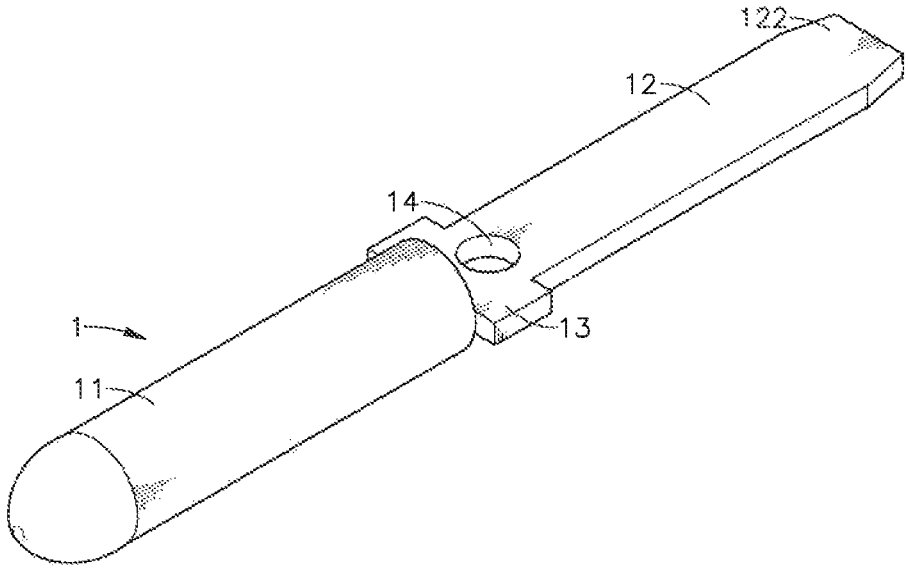
FIG. 7 is an oblique top elevational view of an alternate form of conducting terminal for electrical power connector in accordance with the present invention.
Figure 8:
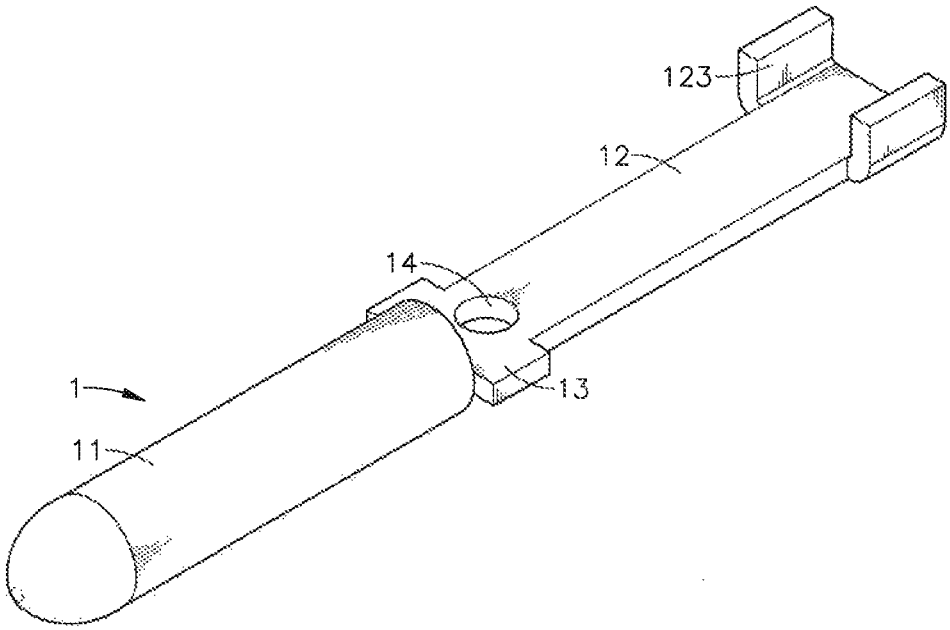
FIG. 8 is an oblique top elevational view of another alternate form of conducting terminal for electrical power connector in accordance with the present invention.
Figure 9:
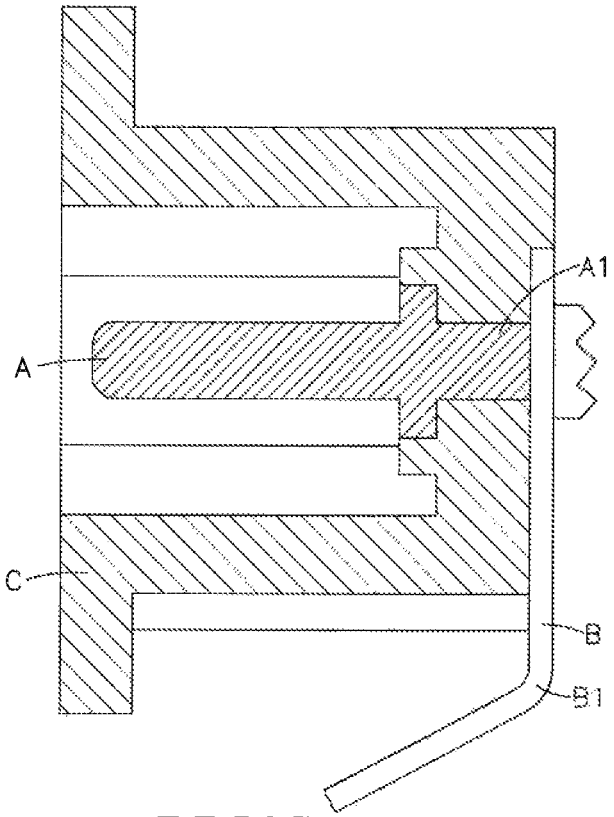
PRIOR ART FIG. 9
FIG. 9 is a sectional side view of an electrical power connector according to the prior art.
Figure 10:
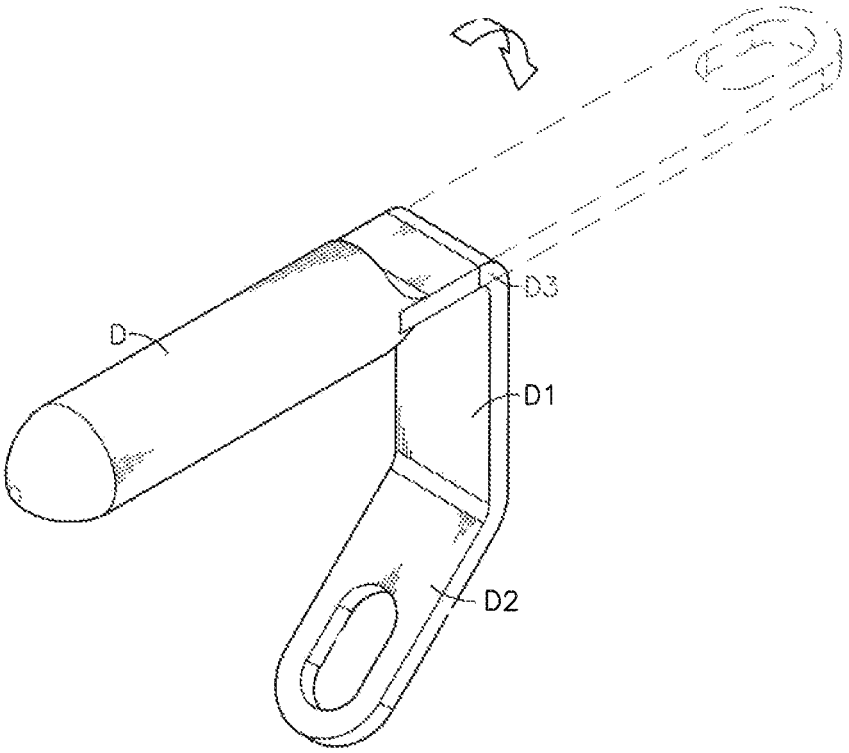
PRIOR ART FIG. 10
FIG. 10 is a schematic drawing illustrating a conducting terminal bending operation during the fabrication of a conducting terminal for electrical power connector according to the prior art.

Referring to FIG. 7 and FIG. 8, two alternate forms of the conducting terminals 1 are shown. According to the alternate form shown in FIG. 7, the plate-like mounting portion 12 has its one end connected to the shoulder 13 and its other end terminating in a reduced tailpiece 122 for DIP (dual in-line package) application. According to the alternate form shown in FIG. 8, the plate-like mounting portion 12 has two clamping flanges 123 bilaterally extended from the rear end thereof remote from the shoulder 13 for securing a lead wire.

Referring to FIGS. 1 and 4-8 again, the conducting terminals 1 can be configured each having at least one through hole 14 at the plate-like mounting portion 12. In the example shown in FIGS. 7 and 8, each conducting terminal 1 has only one through hole 14 located at the connection area between the plate-like mounting portion 12 and the shoulder 13. In the example shown in FIGS. 1-3, each conducting terminal 1 has one through hole 14 located at the connection area between the plate-like mounting portion 12 and the shoulder 13, and another through hole 14 located in the middle of the plate-like mounting portion 12. Further, the number of the bent portion 15 corresponds to the number of the through hole 14, i.e., each bent portion 15 transversely extending across one respective through hole 24. In the example shown in FIGS. 1-3, each conducting terminal 1 has two bent portions 15 respectively transversely extending across the through hole 14 at the connection area between the plate-like mounting portion 12 and the shoulder 13 and the through hole 14 in the middle of the plate-like mounting portion 12 such that the plate-like mounting portion 12 extends vertically downwardly from the shoulder 13 at 90-degrees angle relative to the shoulder 13 and then obliquely forwards at a predetermined angle, for example, 45-degrees angle relative to the mating contact portion 11. Because the bent portions 15 are respectively located at the respective through holes 14, they can be conveniently shaped without causing much stress to the plate-like mounting portion 12, avoiding conducting terminal damage.

Further, the electrically insulative terminal block 2 is a plastic member directly molded on the conducting terminals 1 by insert molding, enabling the mating contact portions 11 of the conducting terminals 1 to suspend in the front mating receiving hole 20 thereof, the shoulders 13 of the conducting terminals 1 to be embedded therein, the plate-like mounting portions 12 of the conducting terminals 1 to be partially embedded therein and the bonding holes 121, reduced tailpiece 122 or clamping flanges 123 of the conducting terminals 1 to suspend out of the bottom side thereof. Further, during insert molding, the applied molten plastic material filled up the through holes 14 at the plate-like mounting portions 12 of the conducting terminals 1, securing the conducting terminals 1 firmly to the electrically insulative terminal block 2.

Further, during formation of the electrically insulative terminal block 2 on the conducting terminals 1, the shoulders 13 of the conducting terminals 1 are embedded in the electrically insulative terminal block 2. Subject to the design that the shoulder 13 of each conducting terminal 1 bilaterally protrudes over the outer diameter of the mating contact portion 11 and the outer diameter of the plate-like mounting portion 12, the shoulders 13 can positively stop the respective conducting terminals 1 against axial displacement relative to the electrically insulative terminal block 2.

In actual application, the electrical power connector of the present invention has the advantages and features as follows:

1. The design of the at least one through hole 14 at the plate-like mounting portion 12 of each conducting terminal 1 enables the plate-like mounting portion 12 to be bent into the desired shape to provide the designed at least one transversely extending bending portion 15 without causing much stress to the plate-like mounting portion 12, avoiding conducting terminal damage.
2. When molding the electrically insulative terminal block 2 on the conducting terminals 1, the applied molten plastic material can fill up the through holes 14 at the plate-like mounting portions 12 of the conducting terminals 1, and therefore the conducting terminals 1 can be firmly secured to the electrically insulative terminal block 2 against displacement after the electrically insulative terminal block 2 is made.

3. During insert molding, the shoulders 13 of the conducting terminals 1 are embedded in the electrically insulative terminal block 2, and therefore the shoulders 13 can positively stop the respective conducting terminals 1 against axial displacement relative to the electrically insulative terminal block 2 during application of the electrical power connector.

In conclusion, the invention provides an electrical power connector comprising a plurality of conducting terminals 1 and an electrically insulative terminal block 2 directly molded on the conducting terminals 1 by insert molding, wherein each conducting terminal 1 comprises a mating contact portion 11 disposed at one end and suspending in a front mating receiving hole 20 of the electrically insulative terminal block 2, a plate-like mounting portion 12 disposed at an opposite end and partially embedded in the electrically insulative terminal block 2 and partially extending out of a bottom side of the electrically insulative terminal block 2, a shoulder 13 connected between the mating contact portion 11 and the plate-like mounting portion 12 and bilaterally protruding over the outer diameter of the mating contact portion 11 and the outer diameter of the plate-like mounting portion 12 and embedded in the electrically insulative terminal block 2, at least one through hole 14 cut through the plate-like mounting portion 12 and embedded in the electrically insulative terminal block 2, and at least one bent portion 15 located at the plate-like mounting portion 12 and respectively transversely extending across each through hole 14 and embedded in the electrically insulative terminal block 2.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical power connector, comprising an electrically insulative terminal block and a plurality of conducting terminals mounted in said electrically insulative terminal block, wherein:

said electrically insulative terminal block is directly molded on said conducting terminals by insert molding, defining a front mating receiving hole in a front side thereof for receiving an external mating electrical connector;

said conducting terminals are made out of metal wire rods, each comprising a mating contact portion disposed at one end thereof and suspending in said front mating receiving hole of said electrically insulative terminal block, a plate-like mounting portion disposed at an opposite end and partially embedded in said electrically insulative terminal block and partially extending out of a bottom side of said electrically insulative terminal block, at least one through hole located at said plate-like mounting portion and embedded in said electrically insulative terminal block, and a bent portion transversely extending across each said through hole and embedded in said electrically insulative terminal block.

2. The electrical power connector as claimed in claim 1, wherein said mating contact portions of said conducting terminals are rod-shaped having a circular or rectangular cross section.

3. The electrical power connector as claimed in claim 1, wherein the through holes of said conducting terminals are selectively circular, oval, rectangular or oblong shaped.

4. The electrical power connector as claimed in claim 1, wherein each said conducting terminal further comprises a bonding hole located at the plate-like mounting portion thereof and suspending outside said electrically insulative terminal block.

5. The electrical power connector as claimed in claim 1, wherein the plate-like mounting portion of each said conducting terminal has a distal end terminating in a reduced tailpiece for DIP (dual in-line package) application.

6. The electrical power connector as claimed in claim 1, wherein each said conducting terminal further comprises two clamping flanges bilaterally extended from a distal end of the plate-like mounting portion thereof for securing an external lead wire.

7. The electrical power connector as claimed in claim 1, wherein each said conducting terminal further comprises a shoulder connected between the mating contact portion and plate-like mounting portion thereof and bilaterally protruding over the outer diameter of the associating mating contact portion and the outer diameter of the associating plate-like mounting portion and embedded in said electrically insulative terminal block; the plate-like mounting portion of each said conducting terminal extends from the associating shoulder at right angles; one said through hole of each said conducting terminal is located at the connection area between the shoulder and plate-like mounting portion of the respective conducting terminal.

8. The electrical power connector as claimed in claim 1, wherein each said conducting terminal further comprises a shoulder connected between the mating contact portion and plate-like mounting portion thereof and bilaterally protruding over the outer diameter of the associating mating contact portion and the outer diameter of the associating plate-like mounting portion and embedded in said electrically insulative terminal block; the number of said at least one through hole of each said conducting terminal is 2, and the two through holes of each said conducting terminal are respectively located at the connection area between the associating plate-like mounting portion and the associating shoulder and at a middle part of the associating plate-like mounting portion; the at least one bent portion of each said conducting terminal is located at the plate-like mounting portion and respectively transversely extends across each through hole and so configured that the plate-like mounting portion of each said conducting terminal extends from the associating shoulder at right angle and then obliquely forwardly extends out of the bottom side of said electrically insulative terminal block at a predetermined angle.

* * * * *